US005887798A

United States Patent [19]

Ohta et al.

[11] Patent Number: 5,887,798

[45] Date of Patent: Mar. 30, 1999

[54] CYLINDER INJECTION TYPE FUEL INJECTION VALVE

[75] Inventors: Hirohisa Ohta; Norihisa Fukutomi, both of Tokyo; Tsuyoshi Munezane; Kensuke Imada, both of Kobe; Keita Hosoyama, Tokyo; Masayuki Aota; Mamoru Sumida, both of Tokyo, all of Japan

[73] Assignee: Mitsubishi Denki Kabushiki Kaisha, Tokyo, Japan

[21] Appl. No.: 886,534

[22] Filed: Jul. 1, 1997

[30] Foreign Application Priority Data

Jan. 30, 1997 [JP] Japan ..... 9-016367

[51] Int. Cl.[6] ..... B05B 1/30

[52] U.S. Cl. ..... 239/585.1; 239/585.5; 251/129.21

[58] Field of Search ..... 239/585.1, 585.3, 239/585.4, 585.5, 900; 251/129.15, 129.21

[56] References Cited

U.S. PATENT DOCUMENTS 4,509,693 4/1985 Nakai ..... 239/585.5
5,427,319 6/1995 Bata ..... 239/585.4
5,570,842 11/1996 Kindley ..... 239/585.1
5,632,467 5/1997 Just et al. ..... 239/585.4 X
5,634,596 6/1997 Abiko ..... 239/585.5
5,634,597 6/1997 Krohn et al. ..... 239/585.5

*Primary Examiner*—Andres Kashnikow
*Assistant Examiner*—Steven J. Ganey
*Attorney, Agent, or Firm*—Sughrue, Mion, Zinn, Macpeak & Seas, PLLC

[57] ABSTRACT

A cylinder injection type fuel injection valve has a metallic ring 15 of a substantially T-like shape which is disposed inside a solenoid 2 and which has inner and outer sides supported by O-rings 16, 17 in order to seal highly pressurized fuel, whereby a change in a flow rate of fuel, which may be resulted by attaching the fuel injection valve to an internal combustion engine, can be minimized without changing largely a sealing structure for fuel, and deformation of the metallic ring is minimized.

15 Claims, 6 Drawing Sheets

CYLINDER INJECTION TYPE FUEL INJECTION VALVE

BACKGROUND OF THE INVENTION

1. Field of the Invention

The present invention relates to a cylinder injection type fuel injection valve to be attached to a cylinder head in order to directly inject fuel into a combustion chamber in an internal combustion engine.

2. Discussion of Background

A conventional cylinder injection type fuel injection valve 20 has such a structure of a combination of an injection valve body 22 with a needle valve 21 and a solenoid 23 for operating the needle valve 21 as shown in FIG. 4, for instance. The solenoid 23 comprises a housing 24, a core 25, a coil assembly 26, a ring 27 made of a thermoset resin, O-rings 28, 29 of an elastic material, a spacer 30 and an armature 31.

Sealing for fuel between the inner periphery of the ring 27 and the outer periphery of the core 25 and between the outer periphery of the ring 27 and the inner periphery of the housing 24 are maintained by means of the O-rings 28, 29 made of an elastic material. The above-mentioned structure minimizes occurrence of the destruction of sealing for fuel, even in a case that heat is abnormally generated due to a supply of an overcurrent to the coil assembly 26, because the ring 27 is made of a thermoset resin whereby deformation of the ring 27 is prevented.

The above-mentioned cylinder injection type fuel injection valve 20 for directly injecting fuel into a fuel chamber is fixed to a cylinder head 32 in an internal combustion engine in such a manner that an outer circumferential portion 24*a* at a lower part of a flange 33 of the housing 24 is inserted in a fitting opening 32*a* in the cylinder head 32, and fixing is effected in the axial direction of the injection valve by fitting metallic members from an upper direction of the flange 33. A fuel supply tube 34 is fixed to the cylinder injection type fuel injection valve 20 by fitting a fitting opening 34*a* to an upper part of the injection valve 20 by interposing an O-ring 35 for-sealing the upper part of the injection valve 20 after the injection valve 20 has been fixed to the cylinder head 32.

In the conventional cylinder injection type fuel injection valve having the above-mentioned construction in which the fuel supply tube 34 is connected to the injection valve 20, there was a problem as follows. Looseness in fitting between the fuel supply tube 34 and the cylinder head 32, and scattering in dimensions of fitting openings 32*a*, 34*a* of the cylinder head 32 and the fuel supply tube 34 might result a misalignment of axis between the fitting openings 32*a* and 34*a* whereby a bending load was applied to a portion of the lower part of the flange 33 of the injection valve and a part to which the O-ring 35 was fitted. The application of the bending load increased an inclination angle of the core because the ring 27 was made of a resinous material. As a result, there was a change of a magnetic circuit formed in the injection valve, and a flow rate was changed.

FIG. 5 is a diagram showing a state that a load is applied to the injection valve which have been fixed to the cylinder head 32 wherein an arrow mark C indicates a force applied to the injection valve in which the axial center of the fitting opening 32*a* deviates from the axial center of fitting opening 34*a*.

FIG. 6 is a diagram showing a state that the core 25 is inclined due to the load applied so that an air gap formed between the core 25 and the armature 31 is ununiform. When the core 25 receives a load D through the O-ring 35, the core 25 is inclined around a fulcrum point as a fastening portion E between the core 25 and the housing 24.

In the cylinder injection type fuel injection valve 20 attached to the cylinder head 32 of an internal combustion engine to directly inject fuel into a combustion chamber, it is necessary that the solenoid 23 generates a large electromagnetic attractive force in order to open quickly the needle valve 21 because a high fuel pressure is applied to the inside of the injection valve.

In the conventional cylinder injection type fuel injection valve, however, it was necessary to use the ring 27 having a large wall thickness F, as shown in FIG. 7, in order to maintain a fracture strength to a high fuel pressure because the ring 27 was made of a thermoset resin. Specifically, it was necessary that the wall thickness F was 1.5 mm or more, in considering scattering in dimensions of the ring formed by molding resin, in order to assure a sufficient strength under a fuel pressure of 8 MPa. This inevitably made the distance between the coil 36 and the air gap portion g longer and increased the number of magnetic fluxes which do not pass through the air gap portion g among magnetic fluxes produced in the coil 36, whereby a sufficient electromagnetic attractive force could not be obtained.

SUMMARY OF THE INVENTION

It is an object of the invention to provide a cylinder injection type fuel injection valve which minimizes a change of flow rate of fuel, which may be caused by fitting the injection valve to a cylinder head, without changing largely the inner structure of the solenoid in a conventional cylinder injection type fuel injection valve.

Further, it is an object of the present invention to provide a cylinder injection type fuel injection valve capable of producing a large electromagnetic attractive force to open the needle valve without changing largely the inner structure of the solenoid in a conventional cylinder injection type fuel injection valve.

According to a first aspect of the present invention, there is provided a cylinder injection type fuel injection valve comprising a valve body of a hollow cylindrical type, a valve seat provided at an end of the valve body and having an injection nozzle for injecting fuel at its center, a valve capable of coming to contact with and separating from the valve seat so that the injection nozzle is opened and closed, a hollow housing having an end connected to the valve body, a core disposed in the housing, and a coil assembly for effecting opening/closing operations of the valve, the coil assembly being arranged around the core and inside the housing, wherein a metallic ring having a substantially T-like shape in cross section is disposed between the outer periphery of the core and the inner periphery of the housing at a side of the coil assembly in the housing, onto which a fuel pressure is applied, and O-rings are disposed at inner and outer sides of the metallic ring.

According to a second aspect of the invention, there is provided a cylinder injection type fuel injection valve according to the first aspect, wherein the wall thickness of a portion between the O-rings and the coil assembly, of the metallic ring is 1.5 mm or less.

According to a third aspect of the invention, there is provided a cylinder injection type fuel injection valve according to the first aspect or the second aspect, there is provided a cylinder injection type fuel injection valve wherein the specific resistance of the metallic ring is 50 $\mu\Omega$.cm or more.

According to a fourth aspect of the invention, there is provided a cylinder injection type fuel injection valve according to the first aspect, the second aspect or the third aspect wherein the relative magnetic permeability of the metallic ring is 2 or less.

In accordance with a fifth aspect of the invention, there is provided a cylinder injection type fuel injection valve according to the first or the second aspect wherein the metallic ring is made of an austenite series stainless steel.

According to a sixth aspect of the invention, there is provided a cylinder injection type fuel injection valve according to the first or the second aspect wherein the metallic ring is made of a nickel alloy.

According to a seventh aspect of the invention, there is provided a cylinder injection type fuel injection valve according to the first or the second aspect wherein the metallic ring is made of sintered alloy.

According to an eighth aspect of the invention, there is provided a cylinder injection type fuel injection valve according to the first or the second aspect wherein the metallic ring is made of sintered alloy manufactured by a metal powder injection molding method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
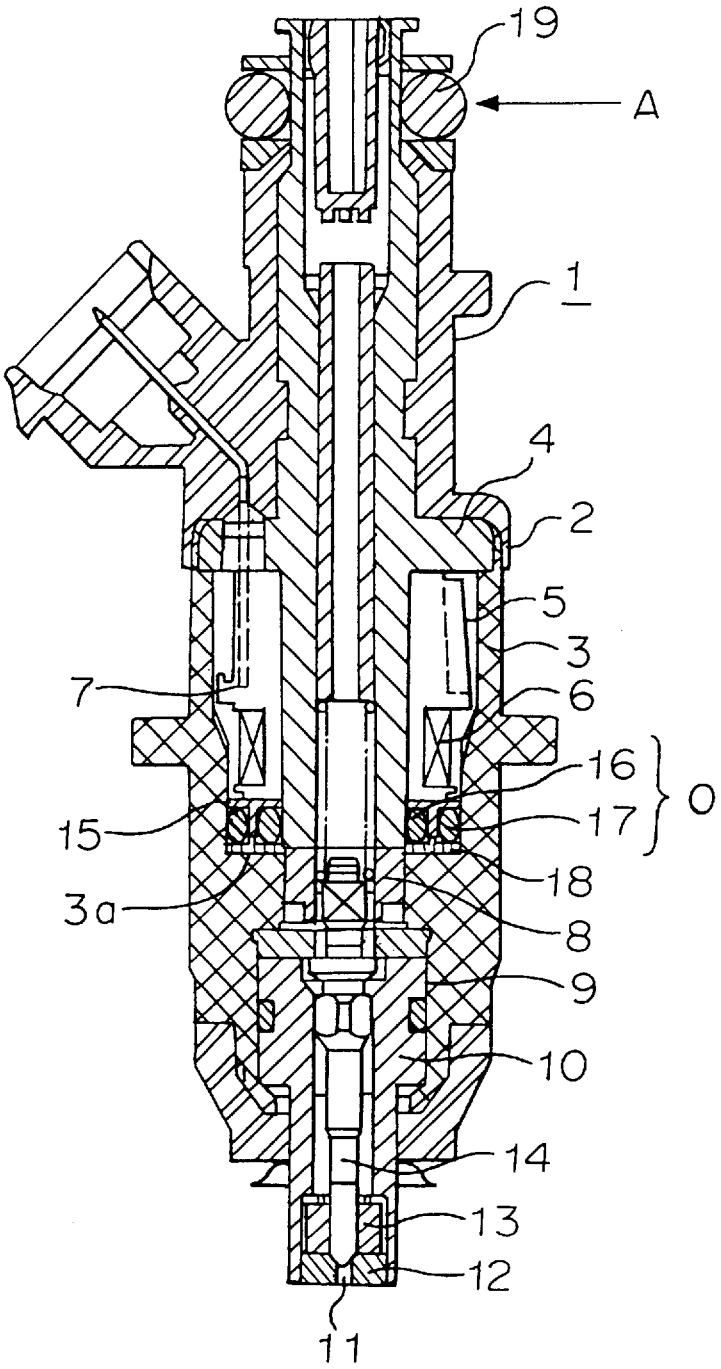
FIG. 1 is a longitudinal cross-sectional view of an embodiment of the cylinder injection type fuel injection valve according to the present invention.

Preferred embodiments of the present invention will be described with reference to the drawings wherein the same reference numerals designate the same or corresponding parts.

FIG. 1 shows an embodiment of the cylinder injection type fuel injection valve according to the present invention.

In FIG. 1, a cylinder injection type fuel injection valve 1 comprises a solenoid 2, a housing 3, a core 4, a coil assembly 5, a coil 6, a bobbin of thermoplastic resin 7, an armature 8 and a valve unit 9. The valve unit 9 is connected to an end of the housing 3 by means of caulking. The valve unit 9 is provided with a valve body 10 of a follow cylindrical shape wherein there are two steps in an outer diameter portion, a valve seat 12 provided with a fuel injection nozzle 11, which is firmly connected to a tip portion of the central opening of the valve body 10, a swirler 13 disposed between the valve seat 12 and the valve body 10 to provide a swirling stream to a sprayed fuel, and a needle valve 14 as a valve which is brought to contact with and separated from the valve seat 12 by the action of the solenoid 2 to thereby open and close the fuel injection nozzle 11.

In the solenoid 2, a metallic ring 15 having a substantially T-like shape is disposed between the core 4 and the housing 3 at a side to which a fuel pressure is applied through the coil assembly 5, and O-rings 16, 17 are disposed at the inside and the outside of the metallic ring 15. A spacer 18 is disposed between the metallic ring 15 and the inner bottom surface 3a of the housing 3. Numeral 19 designates an O-ring fitted to an upper portion of the injection valve 1.

The operations will be described. When an electric current is supplied to the coil 6, a magnetic flux is produced in a magnetic circuit constituted by the armature 8, the core 4 and the housing 3 whereby the armature 8 is moved by an attractive force toward the core 4. Then, the needle valve 14 firmly attached to the armature 8 is separated from the valve seat 12 to form an air gap between the needle valve 14 and the valve seat 12. Then, highly pressurized fuel is passed from the valve body 10 to the injection nozzle 11 and is sprayed into the injection chamber of the internal combustion engine through the tip outlet of the nozzle 11.

During the supply of current to the coil 6, there is a case that a time of supplying an electric current is abnormally long or an excessive amount of electric current is supplied due to a failure in a driving circuit of the like. In such case, deformation of the ring 15 does not take place even by heat generated in the coil because the ring 15 is made of a metallic material although the bobbin 7 made of a thermoplastic resin is deformed due to heat generated in the coil 6. Accordingly, there is no danger of leaking of the fuel out of the cylinder injection type fuel injection valve 1.

Further, the ring 15 is made of a metallic material unlike the conventional ring made of resin. Accordingly, even when a bending load A is applied to a portion of the core 4 where the O-ring 19 is fitted so that the core 4 is slightly inclined whereby the core 4 comes to contact with the ring 15, the rigidity of the ring is high enough to minimize an amount of inclination of the core 4, and accordingly, a change of flow rate of fuel produced at the time of fitting the injection valve to the internal combustion engine can be minimized.

Figure 2:
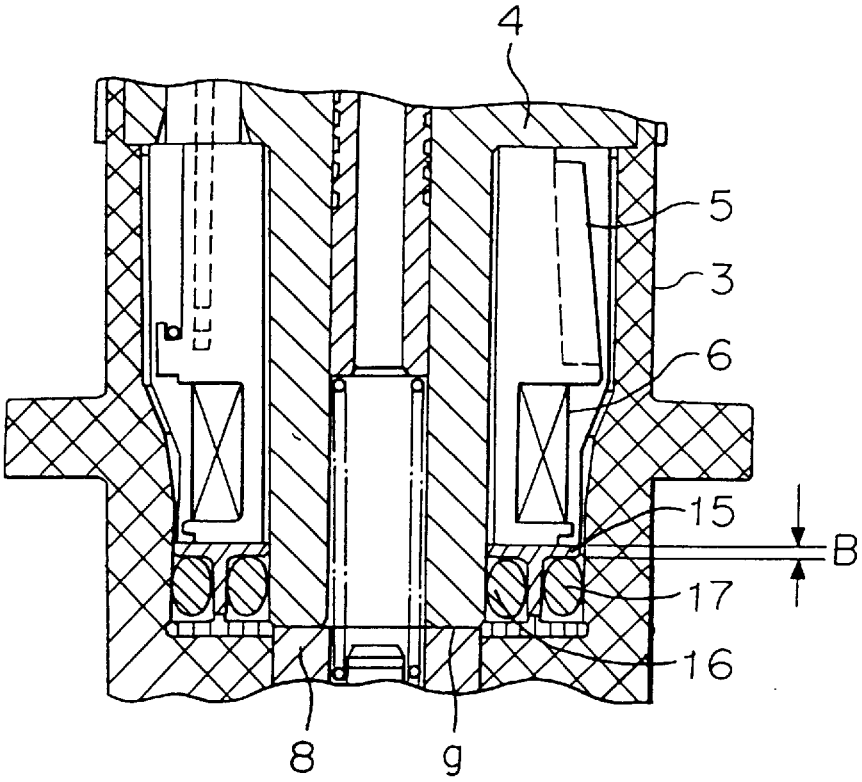
FIG. 2 is an enlarged longitudinal cross-sectional view partly omitted of a solenoid portion in the cylinder injection type fuel injection valve according to the first embodiment.

Further, with use of the metallic ring 15, a wall thickness B of ring can be reduced to a half or less in obtaining the same strength in comparison with a case of using a ring made of resin, as shown in FIG. 2. In this embodiment, the wall thickness B is made thin as 1.5 mm or less whereby the distance between the coil assembly 5 and the air gap portion g can be shortened as shown in FIG. 2. As a result, the number of magnetic fluxes, which do not pass through the air gap portion g, in the total number of magnetic fluxes produced in the coil 6 is reduced whereby an electromagnetic attractive force to the needle valve 14 is increased.

Further, with use of the ring 15 having a wall thickness B of 1.5 mm or less, an eddy current which may take place with a change of magnetic flux passing through the solenoid 2 can be minimized. Accordingly, reduction in the response characteristics of the needle valve 14 caused by the eddy current can be minimized, and an electromagnetic attractive force can be increased without reducing a valve response characteristic required for a cylinder injection type fuel injection valve.

In a cylinder injection type fuel injection valve according to the second embodiment of the present invention, material having a specific resistance of 50 $\mu\Omega$.cm or more is used for the metallic ring 15, whereby the eddy current produced in the ring 15 can further be reduced in comparison with the case of the first embodiment. Accordingly, reduction in the response characteristics of the needle valve 14 due to the eddy current can further be controlled, and an electromagnetic attractive force can be increased without affecting a valve response characteristic required for the cylinder injection type fuel injection valve.

In a cylinder injection type fuel injection valve according to the third embodiment of the present invention, material having a relative magnetic permeability of 2 or less is used for the metallic ring 15, whereby in magnetic fluxes produced in the coil 6, magnetic fluxes bypassing the air gap g to reach the magnetic ring 15 can be in a negligible level in practice, and reduction in an electromagnetic attractive force to the needle valve 14 is prevented.

In the fourth embodiment of the present invention, an austenite series stainless steel having a chrome content of 18% or more is used for the metallic ring 15 whereby the specific resistance is about 70 $\mu\Omega$.cm and the relative magnetic permeability of the metallic ring 15 is 2 or less. Accordingly, at the requirements in the above-mentioned embodiments 2 and 3 wherein the specific resistance be 50 $\mu\Omega$.cm or more and the relative magnetic permeability be 2 or less can simultaneously be satisfied. Thus, the eddy current produced in the metallic ring 15 can be reduced and reduction of an electromagnetic attractive force to the needle valve 14 can be eliminated. Further, the metallic ring 15 having the above-mentioned composition has an excellent anti-corrosion property whereby reduction of the service life of the cylinder injection type fuel injection valve due to rusting can be prevented.

In the fifth embodiment of the present invention, a nickel steel alloy such as Inconel or the like is used for the metallic ring 15. Since the nickel steel alloy such as Inconel has a relative magnetic permeability of 1.2 or less and a specific resistance of 100 $\mu\Omega$.cm or more, the requirements in the above-mentioned embodiments 2 and 3 can simultaneously be satisfied. Accordingly, an eddy current produced in the metallic ring 15 can substantially be reduced and reduction of an electromagnetic attractive force to the needle valve 14 can be eliminated.

Figure 3:
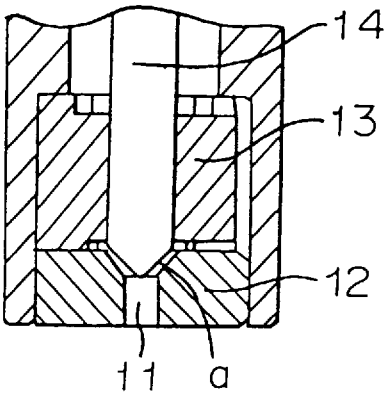
FIG. 3 is an enlarged longitudinal cross-sectional view of a valve seat portion in another embodiment of the cylinder injection type fuel injection valve of the present invention.
Figure 4:
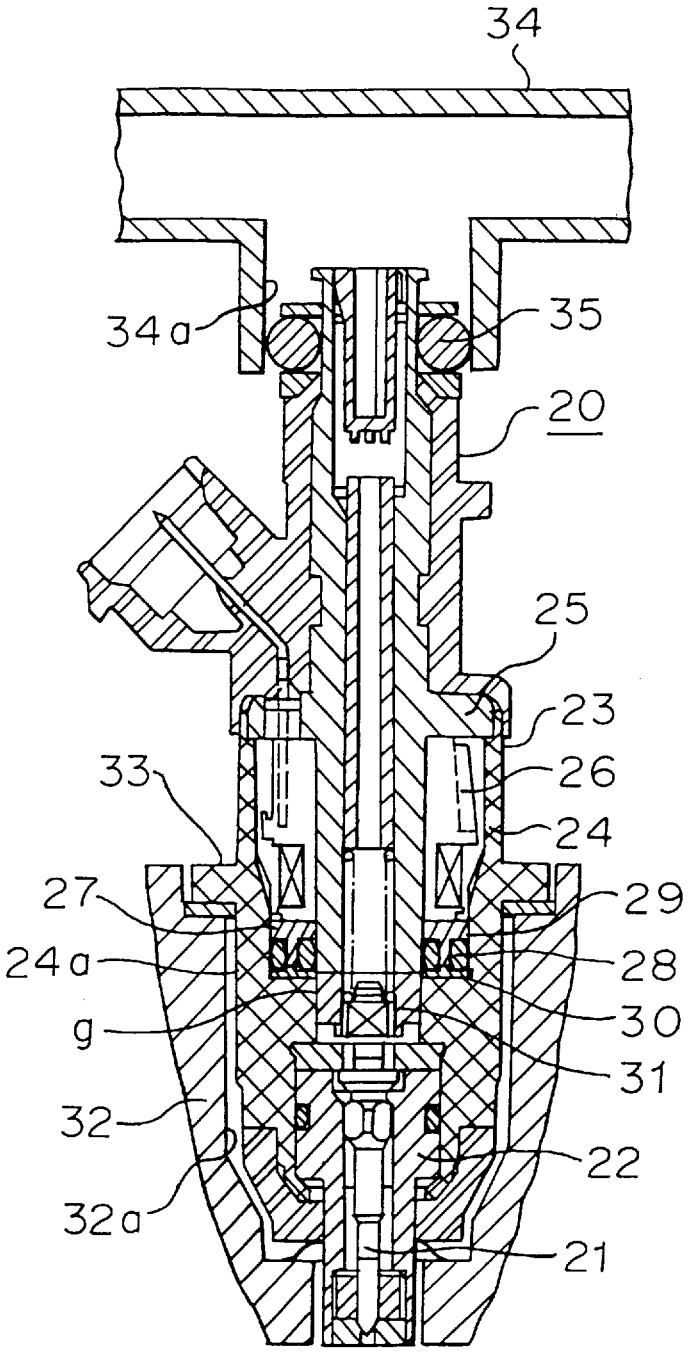
FIG. 4 is a longitudinal cross-sectional view of a conventional cylinder injection type fuel injection valve.
Figure 5:
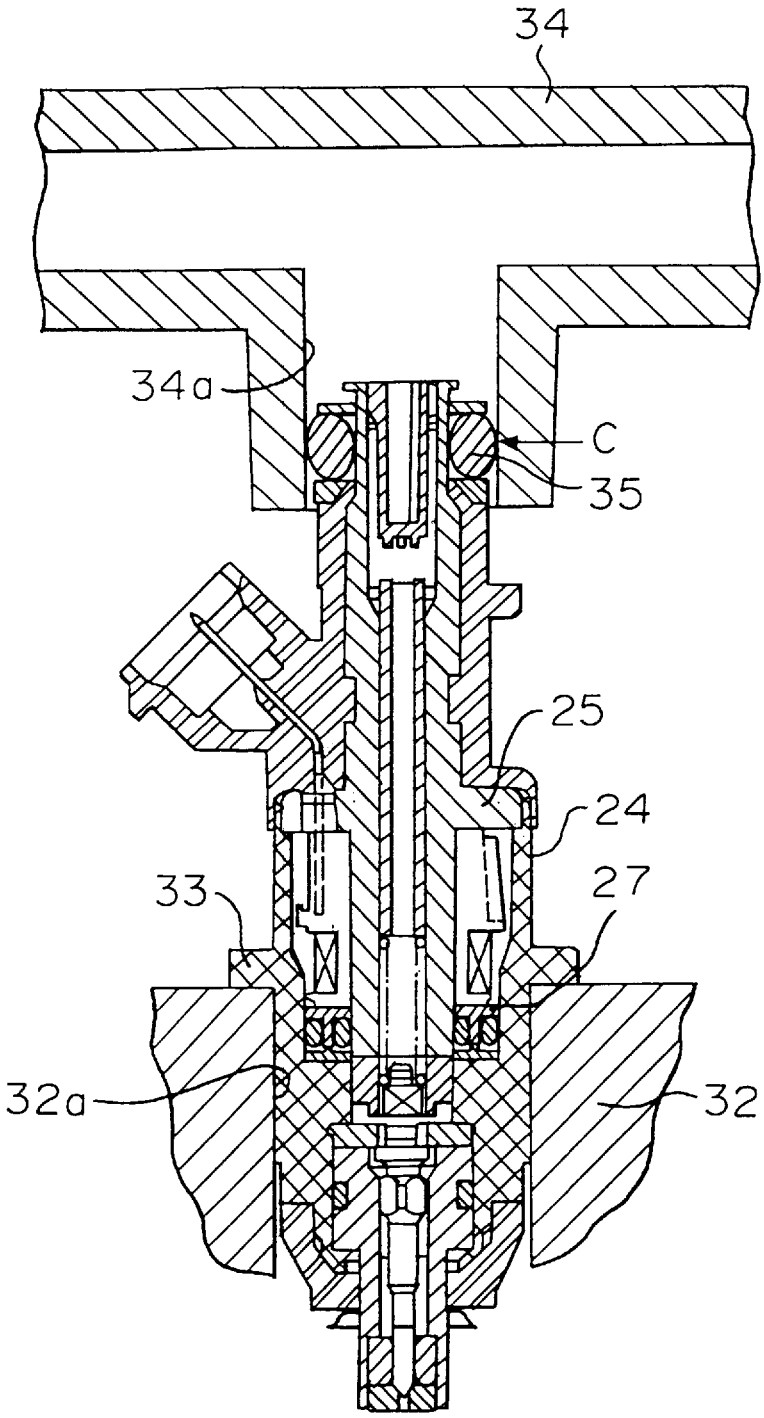
FIG. 5 is a diagram showing a state that the conventional cylinder injection type fuel injection valve is fitted to a cylinder head.
Figure 6:
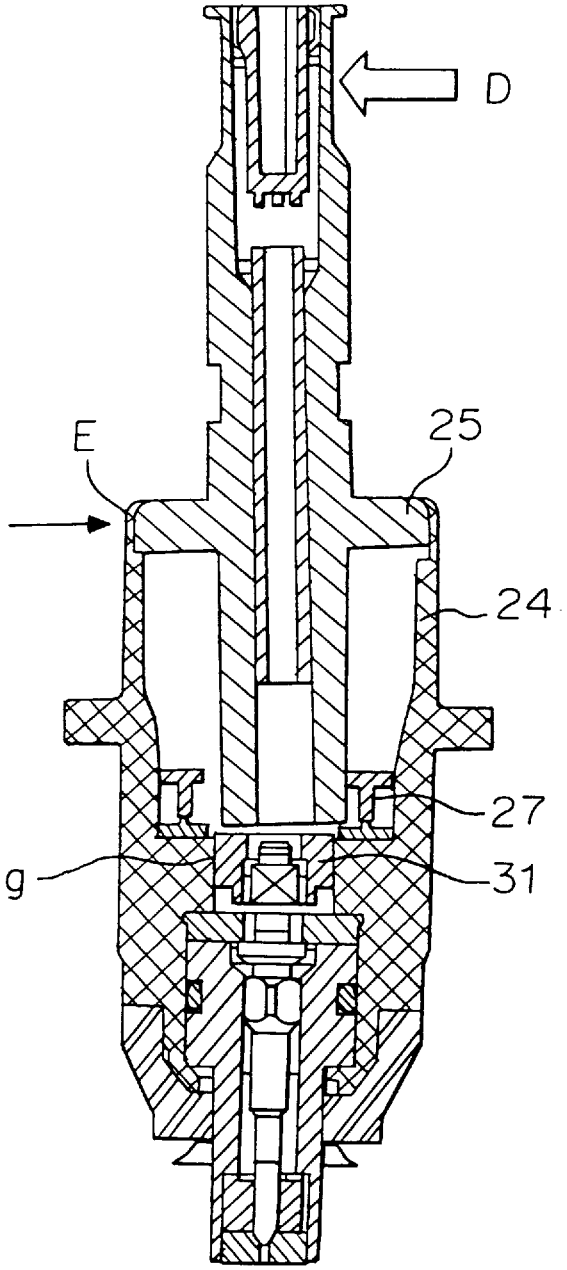
FIG. 6 is a diagram showing a state that the conventional cylinder injection type fuel injection valve is fixed with a certain angle of inclination.
Figure 7:
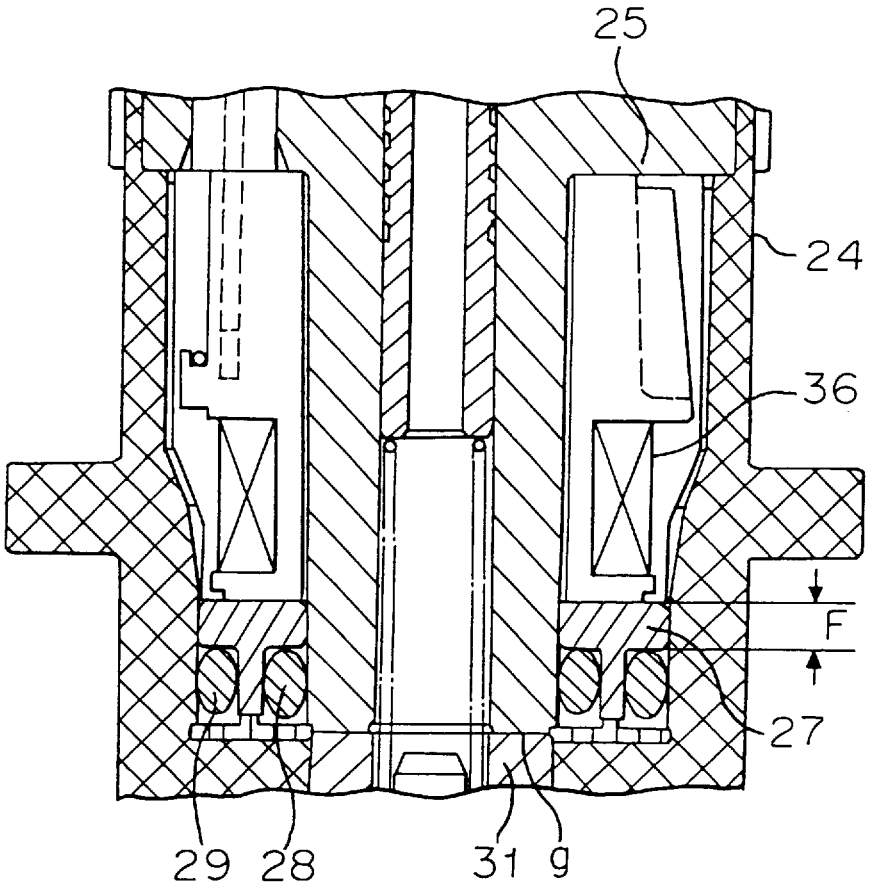
FIG. 7 is an enlarged longitudinal cross-sectional view showing a solenoid portion in the conventional cylinder injection type fuel injection valve.

In the sixth embodiment of the present invention, the metallic ring 15 is made of sintered alloy. Accordingly, manufacturing cost is low in comparison with a case that the metallic ring is manufactured by a cutting operation. Further, an eddy current produced in the metallic ring 15 is reduced because the specific resistance of the ring is increased by using a sintering process. Further, since no burr is produced in a cutting operation, there is a small possibility in entering foreign matters into the inside of the cylinder injection type fuel injection valve, and a disadvantage as shown in FIG. 3 wherein a foreign matter bits a poppet valve constituted by the needle valve 14 and the valve seat 12 can be prevented.

In the seventh embodiment of the present invention, the metallic ring 15 is made of sintered alloy manufactured by a metal powder injection molding method. Accordingly, manufacturing cost is low in comparison with a case that the metallic ring is produced by a cutting operation. Further, since no burr is produced in the cutting operation, there is a small possibility in entering foreign matters into the inside of the cylinder injection type fuel injection valve, and a disadvantage that a foreign matter bits the poppet valve constituted by the needle valve 14 and the valve seat 12 can be prevented. Further, since the metal powder injection molding method provides a product having a higher metal density than a product produced by a metal powder pressurizing molding method, it becomes unnecessary to use a resin filling process in which resin is impregnated into cavities in a product of sintered metal manufactured by the metal powder pressurizing molding method. Accordingly, reliability on sealing of fuel can be improved and manufacturing cost can be reduced.

According to the cylinder injection type fuel injection valve of the first aspect of the present invention wherein a metallic ring having-a substantially T-like shape in cross section is disposed between an outer periphery of a core and an inner periphery of a housing at a side of a coil assembly in the housing, onto which a fuel pressure is applied, and O-rings are disposed at inner and outer sides of the metallic ring, an amount of inclination of the core is reduced in comparison with a case that the ring is made of a resinous material, and a change in a flow rate of fuel produced when the injection valve is fixed to an internal combustion engine can be controlled.

Further, since the ring is made of a metallic material, the wall thickness in the axial direction of the injection valve, of the ring can be half or less in comparison with the case that the ring is made of a resinous material. Accordingly, the distance between the coil assembly and the air gap portion can be shortened whereby the number of magnetic fluxes without passing the air gap portion among the total number of magnetic fluxes produced in the coil is decreased, and an electromagnetic attractive force to the needle valve is increased.

In the second aspect of the invention wherein the wall thickness of a portion between the O-rings and the coil assembly, of the metallic ring is 1.5 mm or less, an eddy current produced in the metallic ring when there is a change of magnetic fluxes passing through the solenoid, can be minimized. Accordingly, reduction in the response characteristics of the needle valve which is caused by the eddy current can be minimized, and an electromagnetic attractive force can be increased without reducing a valve response required for the cylinder injection type fuel injection valve.

In the third aspect of the invention wherein the specific resistance of the metallic ring is 50 $\mu\Omega$.cm or more, occurrence of the eddy current produced in the metallic ring can further be reduced.

In the fourth aspect of the invention wherein the relative magnetic permeability of the metallic ring is 2 or less, the number of magnetic fluxes bypassing the air gap portion to pass through the metallic ring, among the total number of magnetic fluxes produced in the coil can practically be in a negligible level to thereby prevent reduction in an electromagnetic attractive force to the needle valve.

In the fifth aspect of the invention wherein the metallic ring is made of an austenite series stainless steel, the specific resistance is 50 $\mu\Omega$.cm or more and the relative magnetic permeability is 2 or less. Accordingly, an eddy current produced in the metallic ring can be reduced and reduction in an electromagnetic attractive force to the needle valve can be prevented. Further, reduction in the service life of the injection valve due to rusting can be prevented because the metallic ring has an excellent anti-corrosion property.

In the sixth aspect of the invention-wherein the metallic ring is made of a nickel steel alloy such as Inconel or the like, the relative magnetic permeability is 1.2 or less and the specific resistance is 100 $\mu\Omega$.cm or more. Accordingly, there is no reduction in an electromagnetic attractive force, and an eddy current produced in the metallic ring can substantially be reduced.

In the seventh aspect of the invention wherein the metallic ring is made of sintered alloy, manufacturing cost is low in comparison with a case that the metallic rings is manufactured by a cutting operation, and an eddy current produced in the metallic ring is reduced because the specific resistance is increased due to sintering. Further, since there is no burr produced in the cutting operation, possibility of entering of foreign matters into the inside of the injection valve is reduced, and a disadvantage of biting of foreign matters to the poppet valve constituted by the needle valve and the valve seat can be eliminated.

In the eighth aspect of the invention wherein the metallic ring is made of sintered alloy manufactured by a metal powder injection molding method, manufacturing cost is low in comparison with a case that the metallic ring is produced by a cutting operation. Further, since there is no burr produced in the cutting operation, possibility of entering of foreign matters into the inside of the injection valve is reduced, and a disadvantage-of biting of foreign matters to the poppet valve constituted by the needle valve and the valve seat can be eliminated.

Further, since the metallic ring produced by the metal powder injection molding method has a higher metal density than a metallic ring produced by a metal powder pressurizing molding method, it is unnecessary to employ a resinous impregnating process to cavities in a sintered metallic product produced by the metal powder pressurizing molding method. Accordingly, reliability on sealing fuel is improved and manufacturing cost can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. A cylinder injection type fuel injection valve comprising a valve body of a hollow cylindrical type, a valve seat provided at an end of the valve body and having an injection nozzle for injecting fuel at its center, a valve capable of coming to contact with and separating from the valve seat so that the injection nozzle is opened and closed, a hollow housing having an end connected to the valve body, a core disposed in the housing, and a coil assembly for effecting opening/closing operations of the valve, the coil assembly being arranged around the core and inside the housing, wherein a metallic ring having a substantially T-like shape in cross section is disposed between the outer periphery of the core and the inner periphery of the housing at a side of the coil assembly in the housing, onto which a fuel pressure is applied, and O-rings are disposed at inner and outer sides of the metallic ring.

2. A cylinder injection type fuel injection valve according to claim 1, wherein the wall thickness of a portion between the O-rings and the coil assembly, of the metallic ring is 1.5 mm or less.

3. A cylinder injection type fuel injection valve according to claim 2, wherein in the specific resistance of the metallic ring is 50 $\mu\Omega$.cm or more.

4. A cylinder injection type fuel injection valve according to claim 2, wherein the relative magnetic permeability of the metallic ring is 2 or less.

5. A cylinder injection type fuel injection valve according to claim 2, wherein the metallic ring is made of an austenite series stainless steel.

6. A cylinder injection type fuel injection valve according to claim 2, wherein the metallic ring is made of a nickel alloy.

7. A cylinder injection type fuel injection valve according to claim 2, wherein the metallic ring is made of sintered alloy.

8. A cylinder injection type fuel injection valve according to claim 2, wherein the metallic ring is made of sintered alloy manufactured by a metal powder injection molding method.

9. A cylinder injection type fuel injection valve according to claim 1, wherein the specific resistance of the metallic ring is 50 $\mu\Omega$.cm or more.

10. A cylinder injection type fuel injection valve according to claim 9, wherein the relative magnetic permeability of the metallic ring is 2 or less.

11. A cylinder injection type fuel injection valve according to claim 1, wherein the relative magnetic permeability of the metallic ring is 2 or less.

12. A cylinder injection type fuel injection valve according to claim 1, wherein the metallic ring is made of an austenite series stainless steel.

13. A cylinder injection type fuel injection valve according to claim 1, wherein the metallic ring is made of a nickel alloy.

14. A cylinder injection type fuel injection valve according to claim 1, wherein the metallic ring is made of sintered alloy.

15. A cylinder injection type fuel injection valve according to claim 1, wherein the metallic ring is made of sintered alloy manufactured by a metal powder injection molding method.

* * * * *